United States Patent [19]

Parker et al.

[11] 4,338,491

[45] Jul. 6, 1982

[54] COMPATIBLE AM STEREOPHONIC SYSTEM

[75] Inventors: Norman W. Parker, Wheaton; Francis H. Hilbert, Addison, both of Ill.

[73] Assignee: Motorola Inc., Schaumburg, Ill.

[21] Appl. No.: 156,249

[22] Filed: Jun. 4, 1980

[51] Int. Cl.[3] ..... H04H 5/00

[52] U.S. Cl. ..... 179/1 GS

[58] Field of Search ..... 179/1 GS, 1 GD, 1 GC, 179/1 GB; 369/86

[56] References Cited

U.S. PATENT DOCUMENTS 3,068,475 12/1962 Avins ..... 179/1 GS 3,257,512 6/1966 Eilers ..... 179/1 GD 4,225,751 9/1980 Hershberger ..... 179/1 GS

*Primary Examiner*—Douglas W. Olms

*Attorney, Agent, or Firm*—Margaret Marsh Parker; James S. Pristelski; James W. Gillman

[57] ABSTRACT

The signal as transmitted is a compatible AM stereophonic signal with amplitude directly proportional to the monophonic signal 1+L+R. The instantaneous phase angle is the quadrature phase angle modified in that high level, high frequencies in the L-R channel are reduced before carrier modulation. The gain in the high frequency L - R channel may be reduced in proportion to the signal level only, or to both level and frequency, or to the percent of distortion introduced into the high frequencies of the L - R signal by RF filtering of the modulated carrier.

9 Claims, 7 Drawing Figures

COMPATIBLE AM STEREOPHONIC SYSTEM

BACKGROUND OF THE INVENTION

This invention relates to the field of amplitude modulated stereo broadcasting and, more particularly, to a signal having reduced possibility of adjacent channel interference.

Numerous systems have been devised for AM stereo broadcasting, but all compatible systems represent a compromise with respect to the noncompatible, pure quadrature system. When all or part of that compromise consists of adding some adjacent channel interference, modification of the system may be advisable if the trade-off does not introduce other and even less desirable characteristics. The most desirable of such trade-offs would be losing a slight amount of stereo separation at the high frequencies only, in return for preventing possible adjacent channel interference.

SUMMARY OF THE INVENTION

It is an object, therefore, of the present invention to provide a compatible AM stereophonic broadcasting system which will prevent significant adjacent channel interference with no increase in distortion or loss of s/n ratio.

This object and others are provided in a system wherein sum and difference signals are produced from two program signals such as left (L) and right (R) signals. The difference signal is separately coupled to two filters, one having a high-pass characteristic, the other, low-pass. The low-pass filter output is coupled directly to a combining circuit. The high-pass filter output is coupled to the combining circuit through an audio processor or compressor. In the processor, high level signals are attenuated more than low level signals. The output signal of the combining circuit is the modified difference signal which is, together with the sum signal, coupled to the transmitter encoder.

BRIEF DESCRIPTION OF THE DRAWINGS

FIG. 7 is a block diagram of a modification of the transmitter of FIG. 2.

DETAILED DESCRIPTION OF A PREFERRED EMBODIMENT

Figure 1:
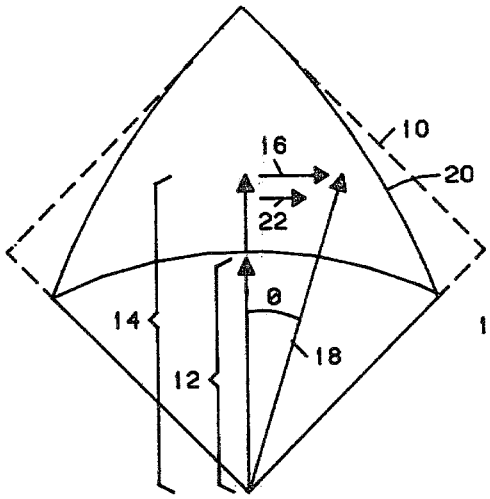
FIG. 1 is a phasor diagram of the transmitted signal.

FIG. 1 is a diagram of the transmitted signal with square 10 (partially dashed line) representing the locus of the possible pure quadrature signals. A phasor 12 represents an unmodulated carrier and a phasor 14 represents a carrier modulated with the sum signal L+R(1+L+R). The difference signal L−R is represented by a phasor 16, shown in quadrature with phasors 12 and 14, indicating that the difference signal would modulate a carrier as 12, but rotated in phase by 90°. The resultant of phasors 14 and 16 is a phasor 18 at an angle $\phi$, where $\phi$ is arc tan[(L−R)/(1+L+R)]. A second locus 20 (solid line) represents the possible transmitted signals of a compatible quadrature system wherein the amplitude is forced to be 1+L+R but the angle $\phi$ remains unchanged. Such a system is disclosed in a copending application, Ser. No. 007,733, assigned to the present assignee. The present invention, however, is not limited to use with the above-referenced system, since any AM stereophonic signal having a compatible envelope will have, potentially, a problem of adjacent channel interference if a high level, high frequency signal is present in only one of the L and R channels. While this combination of signal characteristics can be demonstrated to be extremely rare in program material, the problem does exist theoretically, and the present invention solves the problem in the most advantageous way.

Specifically, high level, high frequency components (f>3 kHz) are reduced in level with respect to the lower frequencies prior to stereo encoding. This reduced level signal is represented by a phasor 22.

Figure 2:
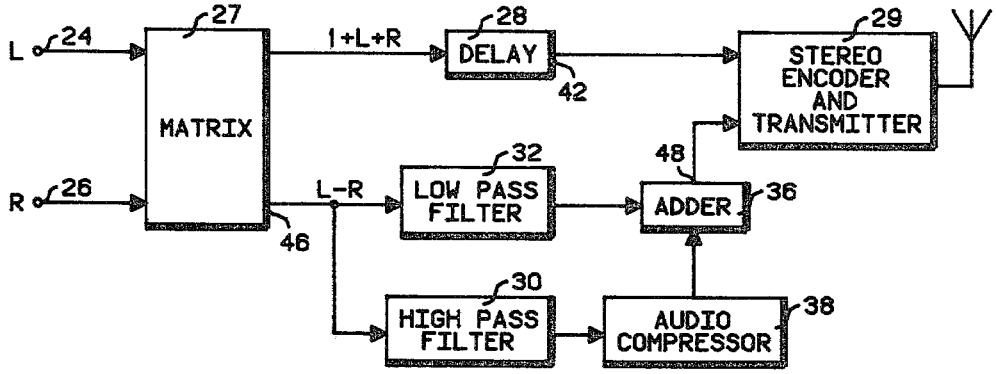
FIG. 2 is a block diagram of a AM stereo transmitter including the invention.

FIG. 2 is a block diagram of an AM stereophonic transmitter wherein two program signals, which may be the usual left (L) and right (R) signals, enter at terminals 24, 26 and are coupled to a matrix 27 which provides sum (1+L+R) and difference (L−R) signals. The sum signal is coupled through a delay element 28 to whatever encoding or modulating circuitry 29 is used in a given system. The difference signal, however, is coupled, separately, to two filters, a high-pass filter 30 and a low-pass filter 32 (see FIG. 4) The delay 28 provides a delay equal to the delays of the filters 30, 32. The output of the low-pass filter is coupled to an adder 36. The output of the high-pass filter 30 is coupled through an audio compressor circuit 38 (see FIG. 6) to the adder 36. The combined signal output of the adder 36, the modified difference signal, is coupled to the encoder 29.

Figure 3:
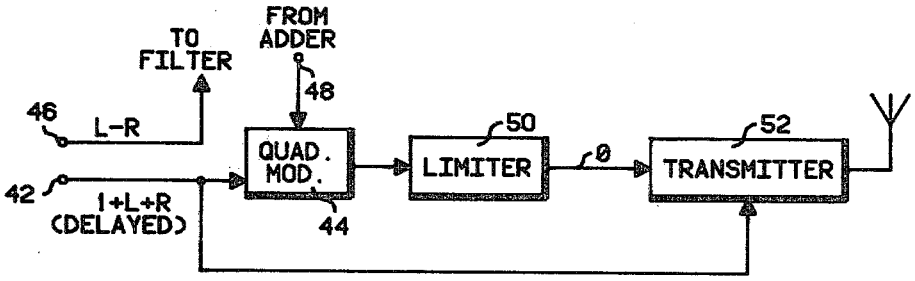
FIG. 3 shows the interconnection of the transmitter of FIG. 2 with a preferred embodiment of the encoder.
Figure 1:
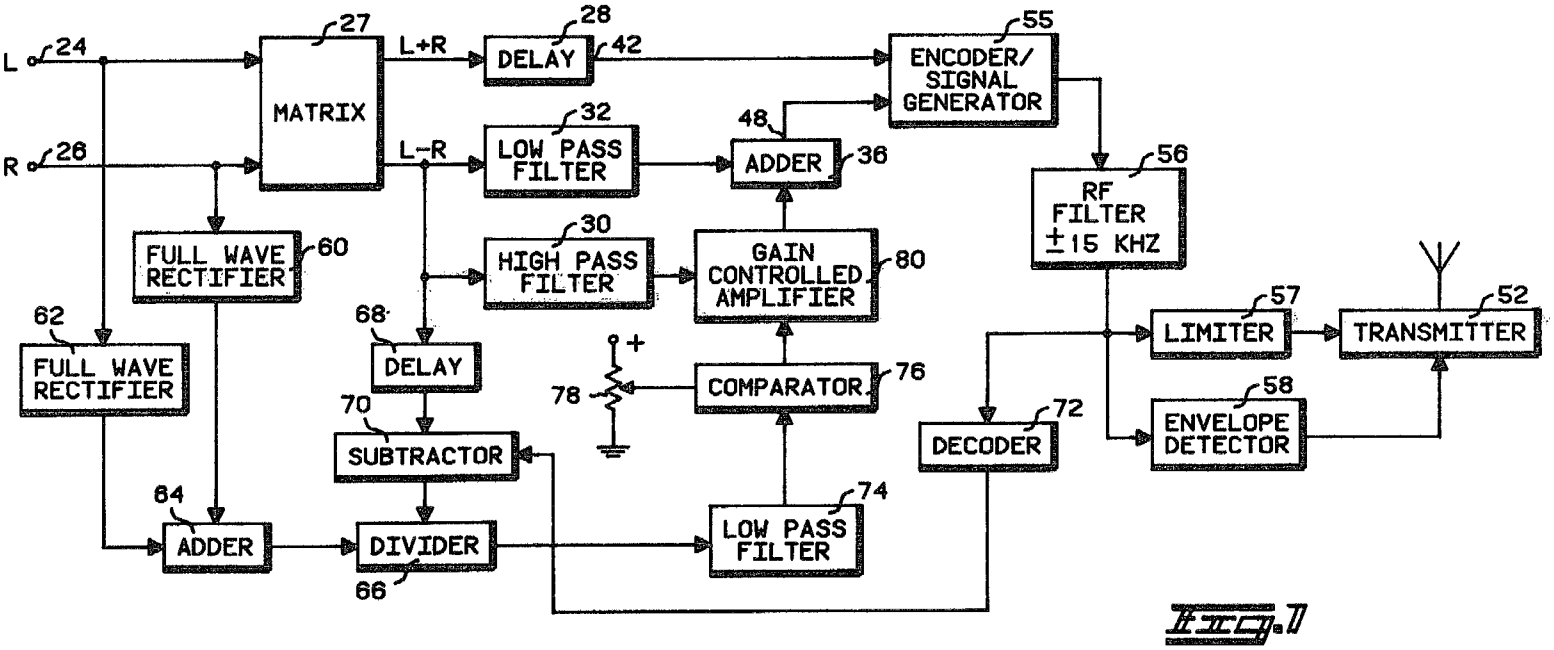

FIG. 3 shows the interconnection of the present invention with the transmitter of the U.S. Pat. No. 4,218,586. The delayed 1+L+R signal from the delay 28 is coupled via a terminal 42 to a quadrature modulator 44. An L−R output terminal 46 of the matrix 28 is coupled to the filters 30, 32. An output terminal 48 of the adder 36 couples the modified difference signal to the quadrature modulator 44. In the quadrature modulator, two carriers in quadrature are modulated with the sum signal and the modified difference signal. The output of the quadrature modulator is coupled to a limiter 50, which removes all amplitude variations. The resultant signal, varying only with the instantaneous phase $\phi$ is coupled to a transmitter 52. The sum signal is also coupled to the transmitter 52 and is the final amplitude modulating signal of the transmitter carrier, thus the signal transmitted is a compatible AM stereophonic signal.

Figure 4:
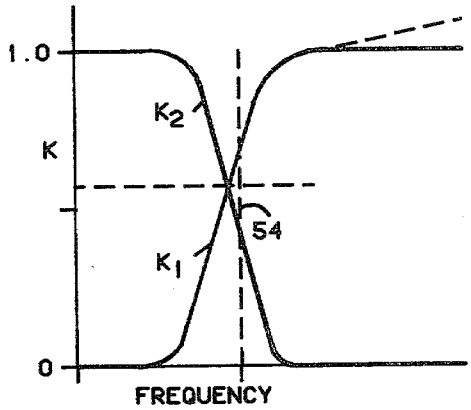
FIG. 4 is a frequency diagram of the filter characteristics.

The frequency diagram of FIG. 4 illustrates the characteristics of the high- and low-pass filters 30, 32 which are complementary; i.e. $k_1+k_2=1$ for all frequencies. Alternatively, $k_1$ of the high-pass filter 30 may have an upward curve (dashed line) of any desired shape, in which case the audio compressor 38 will compress the highest frequencies even more than the lowest frequencies in the passband. In quantitative terms, the frequency at a line 54 would be on the order of 2 kHz, particularly for an RF filter bandwidth of ±15 kHz (FIG. 7).

Figure 5:
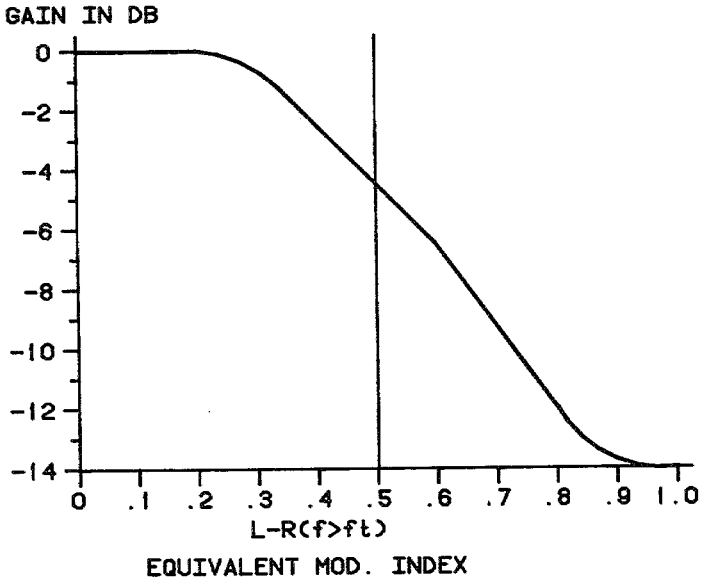
FIG. 5 is a diagram of gain versus modulation index.

The chart of FIG. 5 shows the general shape of the gain vs. modulation index characteristic for the output signal $k_1$(L−R) of the audio compressor. As may be seen, the gain is 0 db for an equivalent modulation index of 0, is approximately −9 db at a 0.5 index, and is approximately −12 db at an index value of 1.0.

Figure 6:
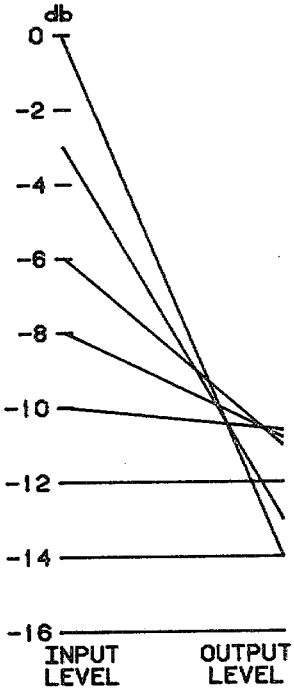
FIG. 6 is a diagram of compressor characteristic.

FIG. 6 shows an exemplary compressor characteristic in a chart of input/output in which the signals are compressed downward. In other words, the lowest level signals are unchanged, and compression increases as the input level increases. The compressor characteristic, as illustrated here, would be exaggerated with frequency if the upward-curved high-pass filter characteristic of FIG. 4 were used.

FIG. 7 is a block diagram of a transmitter embodiment including many of the elements shown in FIGS. 2 and 3, these elements being numbered as before. In this embodiment, however, the signal from the delay 28 and adder 36 are coupled to a stereo encoder/signal generator 55 which could be similar to the stereo encoder and transmitter 29 except that the encoder/generator 55 would not include the high level RF amplifier 52 but would have a low level "mini-transmitter." The output signal from the encoder/generator 55 is coupled through an RF filter 56 which might have, for example, a bandwidth of ±15 kHz, centered around the carrier frequency. This frequency limited signal is then amplitude limited in a limiter 57 and coupled to the transmitter 52. The amplitude variations in the output signal of the RF filter 56 are decoded in an envelope detector 58 and coupled to the transmitter 52 for modulating the carrier for compatible stereophonic broadcasting.

The input signals from the terminals 24, 26 are also coupled separately to a pair of full wave rectifiers 60, 62, the rectified outputs are summed in an adder circuit 54 to obtain a signal proportional to the sum of the absolute values of L and R, and this signal is coupled to a divider circuit 66. The difference signal L−R from the matrix 27 is coupled to a delay element 68 having essentially the same delay period as delay 28. The delayed signal is coupled to a subtractor circuit 70. The output signal from the RF filter 56 is also coupled through a decoder circuit 72 which detects the modulation on the filtered RF signal which was derived from the L−R signal. The decoder 72 output, which is approximately L−R, is coupled to the subtractor circuit 70 where it is subtracted from the L−R signal coming from the delay 68. The output signal of the subtractor 70 is thus a measure of the distortion in the L−R information to be transmitted. The subtractor output is coupled to the divider 66, making the divider output signal represent the distortion in terms of percentage of the sum of the absolute values of the L and R signals. The divider 66 output signal is coupled through a filter 74 having a very low-pass characteristic, thus averaging the distortion signal. The filter output is coupled to a comparator 76 for comparison with a reference voltage from a reference source 78 which may be controllable. The comparator output is coupled to a gain controlled amplifier 80 for controlling the gain in the high frequency L−R channel fed by thwe filter 30. The gain of the amplifier 80 will be effectively 1.0 under most signal conditions. However, in the event that there is a high level, high frequency signal in one of the L and R channels, there would be sidebands beyond 15 kHz at the output of the encoder 44. These sidebands, which might cause adjacent channel interference, are filtered out in the RF filter 56. In this case, the output signal of the decoder 72 would be an L−R signal distorted in proportion to the high level, high frequencies in the L−R output of the matrix 27. The output signal of the divider 66, representing percent distortion would be averaged and compared with the reference and, if greater than the reference level, the gain of the amplifier 80 would be driven down until the percent distortion signal is no greater than the reference signal level.

Thus, there has been shown and described transmitter arrangement wherein any possible adjacent channel interference is prevented by attenuating high level, high frequencies in the L−R channel. Many variations and modifications of the present invention are possible and it is intended to cover all such which fall within the spirit and scope of the appended claims.

What is claimed is:

1. A compatible AM stereophonic broadcasting system comprising:
   - first and second input means for receiving first and second information signals;
   - matrixing means coupled to the input means for providing sum and difference signals;
   - first audio filter means coupled to the matrixing means for passing difference signal frequencies above a predetermined frequency;
   - second audio filter means coupled to the matrixing means for passing difference signal frequencies below the predetermined frequency;
   - audio processor means coupled to the first filter means for reducing the amplitude of high level, high frequency signals in the first filter output;
   - combining means coupled to the second filter means and the audio processor means for combining the respective output signals;
   - delay means coupled to the matrix means for delaying the sum signal by a period substantially equal to the delay period of one of the filter means; and
   - encoding and signal generating means coupled to the delay means and combining means for generating a composite stereophonic signal.

2. A compatible AM stereophonic broadcasting system according to claim 1 wherein the encoding and signal generating means modulates the carrier in quadrature with the outputs of the delay means and the combining means, and for modulating the amplitude of the carrier with the output of the delay means.

3. A compatible AM stereophonic broadcasting system according to claim 1 wherein the encoding and signal generating means modulates the phase of the carrier with the output of the combining means, and the amplitude of the carrier with the output of the delay means.

4. A compatible AM stereophonic broadcasting system according to claim 1 wherein the encoding and signal generating means includes a quadrature modulator coupled to receive the output signals of the delay means and the combining means, limiter means for limiting the modulator output signal, and signal generating means for modulating the output signal of the limiter means with the output signal of the delay means.

5. A compatible AM stereophonic broadcasting system according to claim 1 wherein the encoding and signal generating means includes first modulator means for generating as stereophonic signal, RF filter means for reducing the bandwidth of said sterephonic signal, limiter means coupled to remove the amplitude variations of the RF filter means output, envelope detector means for detecting the amplitude modulation of the RF filter means output, and transmitter means coupled to the outputs of the limiter means and the envelope detector means.

6. A compatible AM stereophonic broadcasting system according to claim 1 wherein the audio processor means is adapted to compress the amplitude of the first filter output as a function of amplitude level.

7. A compatible AM stereophonic broadcasting system according to claim 1 wherein the audio processor means is adapted to compress the amplitude of the first filter output as a function of both amplitude level and frequency.

8. A compatible AM stereophonic broacasting system according to claim 1 wherein the encoding and signal generating means includes RF filter means for limiting the bandwidth of the transmitted signal, decoder means for deriving an approximate difference signal from the RF filter output, comparator means for providing a control signal representative of the distortion in the approximate difference signal, the comparator output being coupled to control the gain in the audio compressor.

9. A compatible AM stereophonic broadcasting system according to claim 5 and further including first and second full wave rectifiers coupled to the first and second input means respectively, second combining means coupled to the first and second rectifiers for combining the respective output signals, decoder means coupled to the RF filter means for deriving an approximately difference signal from the RF filter output, second delay means coupled to the matrix means for delaying a difference signal output by a period substantially equal to the delay period of one of the filter means, third combining means coupled to the second delay means and the decoder means for subtractively combining the respective output signals, divider means coupled to divide the output signal of the third combining means by the output signal of the second combining means, third audio filter means having a low-pass characteristic with cutoff frequency substantially lower than said predetermined frequency, and comparator means coupled to control the gain of the audio processor means in response to the output signal of the third audio filter means.

* * * * *